United States Patent [19]

Gazzarrini

[11] Patent Number: 4,664,044

[45] Date of Patent: May 12, 1987

[54] MACHINE FOR SEWING GUSSETS ON KNITTED GARMENTS OF THE "PANTYHOSE" TYPE WITH AUTOMATIC FEED

[75] Inventor: Vinicio Gazzarrini, Impruneta, Italy

[73] Assignee: Solis S.r.l., Florence, Italy

[21] Appl. No.: 535,854

[22] Filed: Sep. 26, 1983

[30] Foreign Application Priority Data

May 3, 1982 [IT] Italy ..... 9391 A/82

[51] Int. Cl.[4] ..... D05B 21/00

[52] U.S. Cl. ..... 112/121.15; 112/104; 112/121.26; 223/43

[58] Field of Search ..... 112/121.15, 121.11, 112/121.12, 121.29, 121.26, 2, 104; 223/43

[56] References Cited

U.S. PATENT DOCUMENTS

| | | | |
|---|---|---|---|
| 4,444,140 | 4/1984 | Moyer | 112/121.15 X |
| 4,485,753 | 12/1984 | Silla | 112/121.15 X |
| 4,516,513 | 5/1985 | Gazzarrini | 112/121.15 X |
| 4,549,493 | 10/1985 | Gazzarrini | 112/121.15 |

FOREIGN PATENT DOCUMENTS

| | | |
|---|---|---|
| 2443523 | 7/1980 | France . |
| 2103257 | 2/1983 | United Kingdom . |

*Primary Examiner*—H. Hampton Hunter

*Attorney, Agent, or Firm*—McAulay, Fields, Goldstein & Nissen

[57] ABSTRACT

Apparatus for preventing wrinkles on the edge of fabric to be sewn to the gusset of a knitted garment of the "pantyhose" type which must be automatically transferred onto a machine for sewing gussets, which includes:

(a) a head comprising a tubular support (40), on which rests freely a collar (50) containing circularly arranged several hooked rods (60), positioned angularly equidistant and capable of opening out radially for holding a garment (37) by the stretched edge of its fabric to be sewn to a gusset while the garment is being drawn inside a support (40);

(b) padded pincers (10—10) or a pneumatic suction device (11) for initially stretching lengthwise panty portion (35) of garment (37) and then, while keeping it stretched, for bringing it gradually closer to inlet (42) of support (40), while it is being drawn inside support (40);

(c) two vertical pneumatic suction devices (20) for stretching the legs (36) of the garment before they are separately drawn inside said support (40); and (d) a cup-shaped rubber buffer (12), which can be introduced with slight elastic pressure into the inlet (42) of the support (40).

20 Claims, 7 Drawing Figures

MACHINE FOR SEWING GUSSETS ON KNITTED GARMENTS OF THE "PANTYHOSE" TYPE WITH AUTOMATIC FEED

FIELD OF THE INVENTION

The invention concerns a machine for sewing gussets on knitted garments of the pantyhose type with automated feed.

Patent Information Disclosure Spanish Pat. No. 504,417 describes an automatic machine by means of which a knitted garment of the pantyhose or tights type, is removed from a machine that sews the seams joining two stockings to form the panty of the garment by the circularly stretched edge of an area left seamless and to be fitted with a gusset. This removal is effected by means of annular pincers with elements opening out radially, and subsequently the garment is positioned with the stretched edge concentrically outside the horizontal circular opening of the support of a machine which applies and sews the gussets. Then the garment is transferred onto the support, after which the entire garment is drawn upward inside the support, leaving outside, on the lower section of the support, a sufficient amount of fabric to sew the gusset.

Undesirably, during this last operation, especially with certain types of highly elastic fabric, numerous wrinkles or creases are formed on the edge to be sewn and, with the subsequent sewing of the gusset, they remain permanently in the finished garment, thereby greatly lowering its quality.

OBJECTS AND SUMMARY OF THE INVENTION

An important object the present invention is to eliminate this drawback. Another is to provide apparatus for so doing. These results have been achieved in accordance with this invention by stretching the panty and the legs of the garment lengthwise, before and while the panty is drawn inside support while maintaining in a circularly stretched condition the edge of the fabric to be sewn to the gusset.

The machine of the invention includes means to hold and circularly stretch the edge of the fabric to be sewn to the gusset and means to stretch the panty and the legs of the garment lengthwise and to bring said panty, whilst keeping it stretched, close to the inlet of support while it is being drawn inside said support, and optionally means to perform, from inside the support, a subsequent further stretching of the edge of fabric in contact with the support.

An important advantage obtained with the present invention is that it becomes possible to transfer the garment onto a gusset-sewing machine without forming wrinkles on the edge of fabric to be sewn to the gusset with any type of fabric, even if it is highly elastic; this transfer being automated and therefore rapid.

These and further objects, advantages and features of the invention will become evident from the following description and accompanying drawings, shown by way of non-limiting examples and wherein.

DISCLOSURE OF BEST MODES OF THE INVENTION

Figure 1:
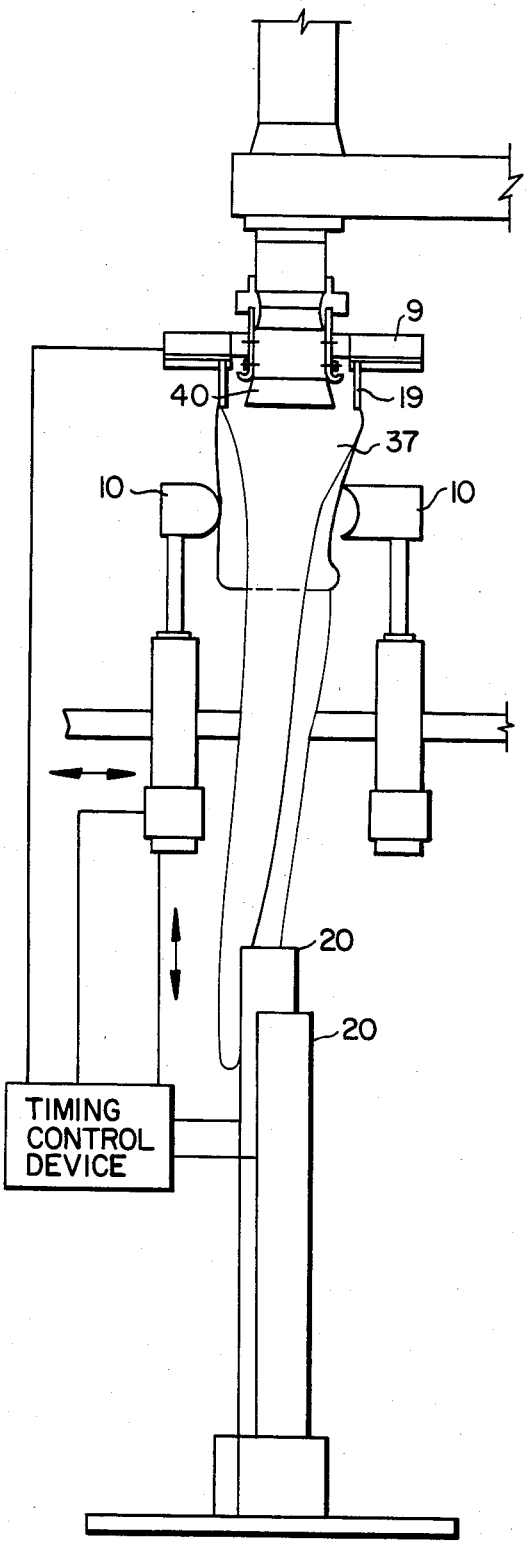
FIG. 1 shows an overall schematic view of the inactive devices to hold the garment and to stretch the panty and the legs lengthwise for a machine according to the invention and while the garment is still held by the feed mechanism.

Briefly stated, the invention resides in apparatus for use with a machine for sewing gussets on knitted garments of the pantyhose type with automated feed which includes several interrelated elements including:

a head with:

a tubular support (40) with a vertical axis and a horizontal inlet (42), a collar (50) sliding vertically on support (40) and surrounding several circularly arranged straight rods (60), each rod having a lower hooked end and being angularly equidistant and hinged onto hinge (61) of support (40) for vertical oscillation relative to the support and for radial opening out of their lower hooked end (63);

an elastic ring (70) around the upper ends (62) of rods (60) for opening rods (60) outwardly, a pneumatic cylinder (80) mounted on a full part of the machine with a vertical shaft operating with its fulcrum (91) for controlling the vertical travel of collar (50) on support (40) through the interposition of fork (90) and the raising and lowering of hooked ends (63);

means underneath support (40) for holding or releasing, respectively, the panty portion (35) of the garment;

Two vertical pneumatic suction devices (20) located in an area underneath the head to draw and stretch lengthwise the legs (36) of the garment; and a buffer (12) coaxially positioned underneath the support and vertically introducible selectively into a horizontal inlet (42) of support (40). The buffer preferably is cup-shaped and has holes (13).

Preferably, support (40) has on its outer surface a first horizontal circumferential groove (43) which is semicircular in cross section, and a second groove (44) having a triangular cross-section above the first horizontal circumferential groove, which receives the upper ends of rods (60) to allow the rods to radially open outwardly when the pincers (9) of the automated feed mechanism are raised. These pincers with the bars on pins (19) form pliers which grip the garment and are actuated by a timing control device.

Similarly, collar (50) can include several longitudinal slots (51) housing rods (60), a horizontal flange (52) intercepting transversely horizontally projecting pinds (64) provided on rods (60) and a horizontal groove (53) housing a free end of fork (90).

Preferably, each of rods (60) includes:

a semicircular horizontally extending projection (61) received in the first groove (43) of support (40);

a hinged pin (64) projecting radially outwardly from the rod and of such a length that it is interceptable by a circular flange (52) in the collar (50), to bring rods (60) close to support (40);

a horizontal projection (65) extending above the lower hooked end (63) of the rod to aid in removing garment (37) from the resilient pincers (9) of the automatic feed mechanism and to transfer the garment onto rods (60) when pincers (9) are lifted.

Also, the means underneath the support can comprise pincers (10—10) equipped with buffers made of rubber or similar material to provide a secure hold on the fabric of the knitted garment.

In a modified embodiment, the means underneath the support comprises a vertical pneumatic suction device (11) movable horizontally to position itself axially underneath the support (40) and vertically to approach the inlet (42) of the support (40).

Similarly, the present apparatus can have means associated with the two pneumatic suction devices (20) for operating them to release the legs (36) of the garment (35), one at a time, only.

Optionally, the additional buffer (12) is shaped as a cup and has several lateral holes (13) and a diameter at its top such that it is introducible with only slight elastic pressure into the inlet of support (40).

Figure 2:
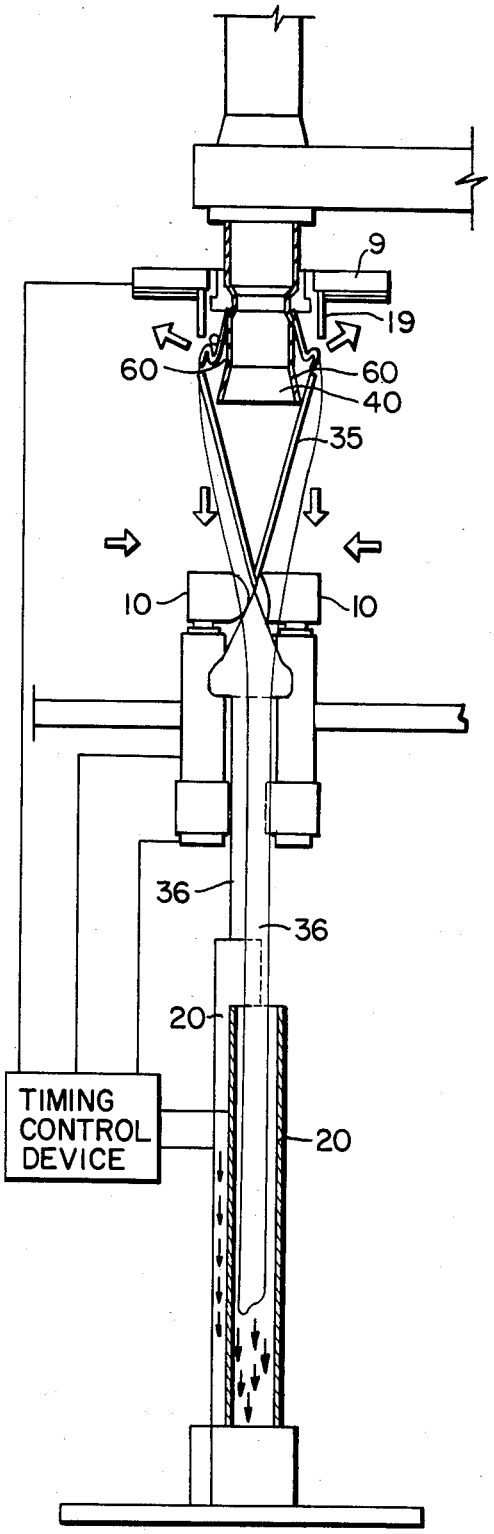
FIG. 2 shows the devices in FIG. 1 in the active stage, immediately after picking up the garment.
Figure 3:
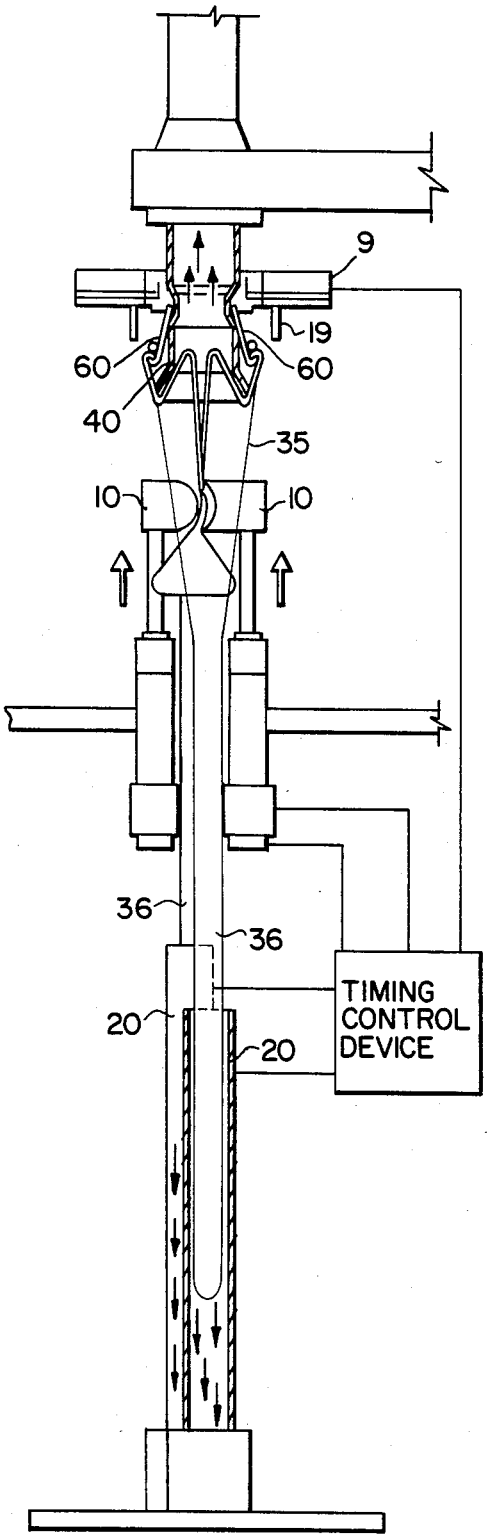
FIG. 3 shows the devices in FIG. 1 in the active stage, while the panty is being drawn inside the support.
Figure 4:
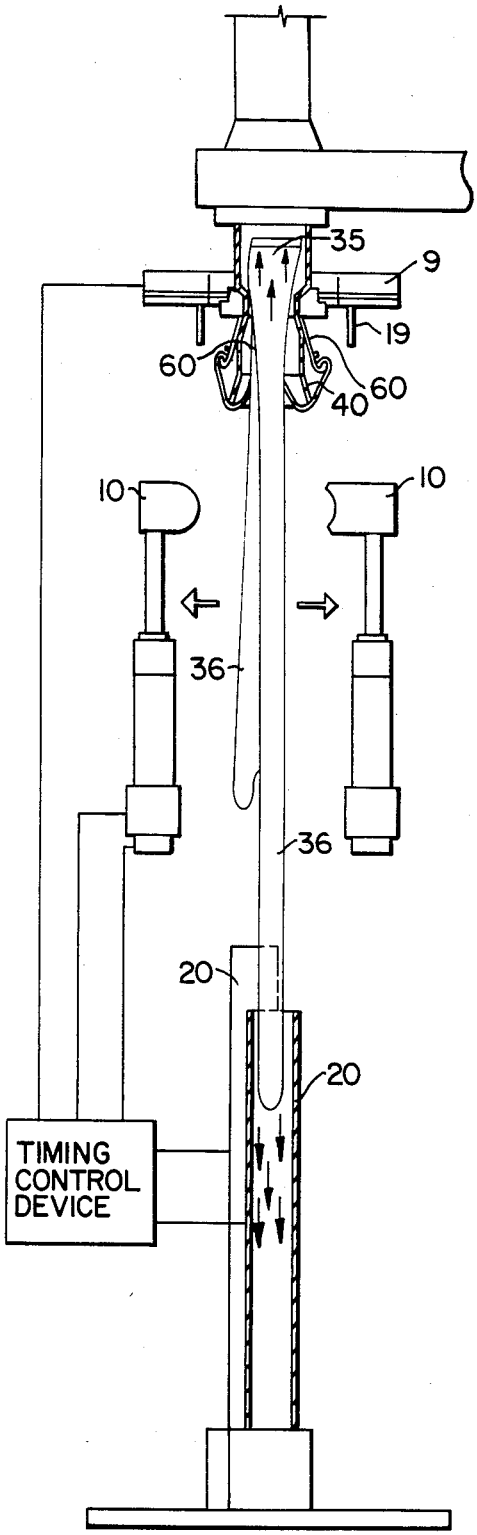
FIG. 4 shows the devices in FIG. 1 after the panty has been fully drawn inside the support and while one of the legs is being drawn inside said support.
Figure 6:
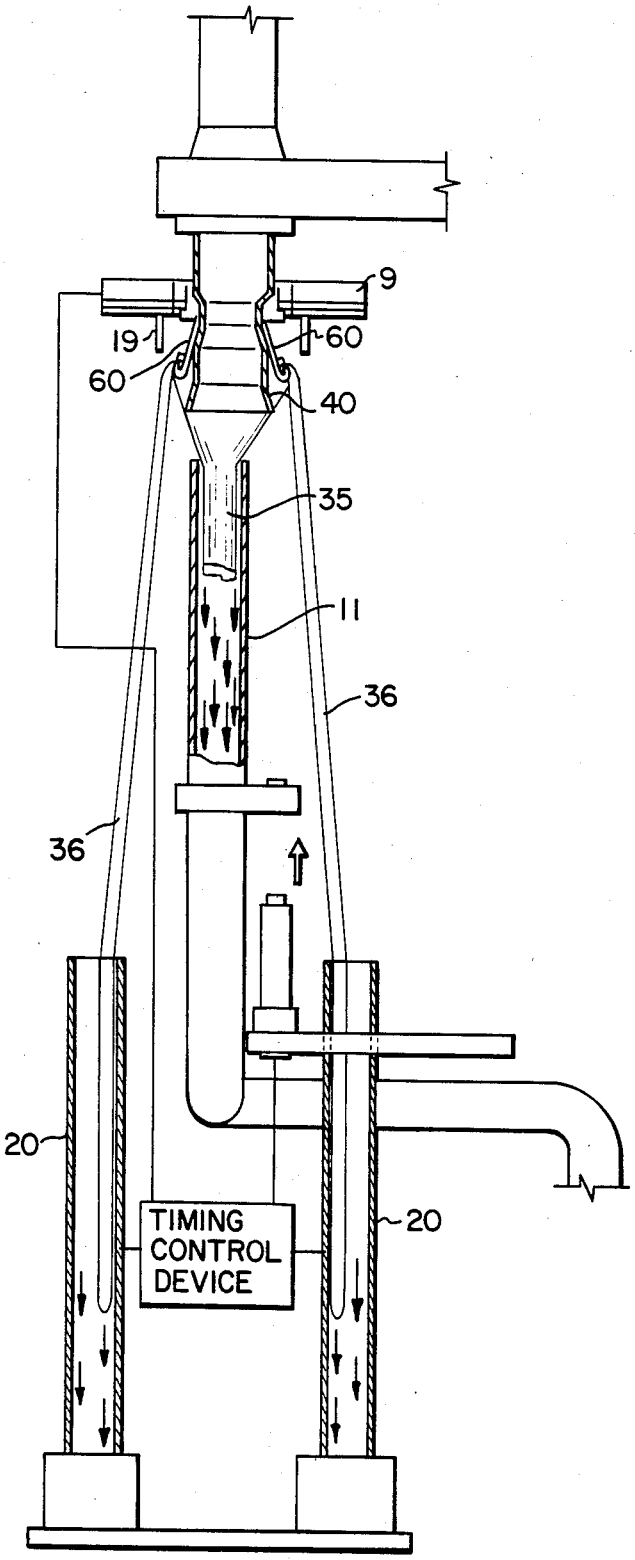
FIG. 6 shows the alternative devices for stretching the panty of the garment before it is drawn inside the support.
Figure 7:
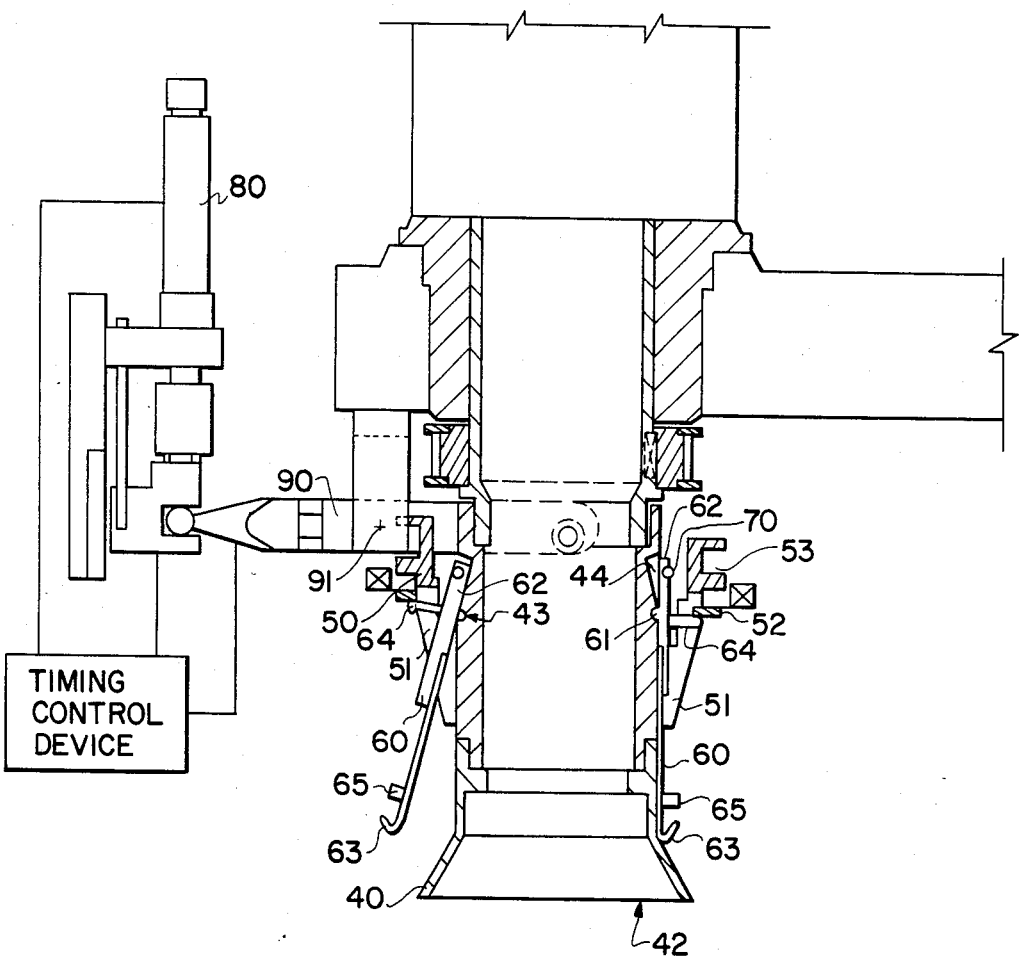
FIG. 7 shows a detailed vertical section of the head of the machine according to the invention, where the left-side half shows the collar (50) in the raised position and the right-hand half shows the same collar (50) in the lowered position.

Referring particularly to FIGS. 1, 4 and 7, the apparatus of the invention functions as follows:

After the pincers (9) the automatic feed mechanism have been positioned concentrically with the support (40), with garment (37) held by means of the bars (19) extending from the pincers while the padded pincers (10—10) are open and the hooked rods (60) are retracted (as shown in FIG. 1) by means of the timing control device connecting pincers (9), the suction devices (20) and the padded pincers (10—10). The pneumatic cylinder (80) is actuated by a timing control device connecting the cylinder with fork (90). The fork (90), shown in FIG. 1, raises the collar (50), causing the opening out of the hooks (63), with the effect—in combination with the lifting of the pincers (9) which frees the garment from the pins (19)—of removing and holding the garment on the rods (60) by the circularly stretched edge of the fabric to be sewn to the gusset. Then, the legs (36) are drawn inside the tubes (20), the padded pincers (10—10) are closed, thereby causing the panty portion (35) of the garment (37) to be gripped, and then the pincers (10—10) are lowered, thereby causing the panty (35) to be stretched lengthwise (as shown in FIG. 2). Next, pneumatic suction inside the support (40) is actuated, and simultaneously the pincers (10—10) are brought closer up to the inlet (42) of the support (40) by the timing control device shown in FIG. 3, thereby causing the panty (35) to be gradually drawn inside the support (40) with the fabric stretched and therefore without forming wrinkles in the area which covers the inlet of the support. When the pincers (10—10) are close to the inlet of the support, they open and when the entire panty (35) has been drawn into the support (40), the suction devices (20) shown in FIGS. 1, 4 and 6, are turned off one after the other by the timing control device, to enable the legs (36) to be drawn separately into the same support (40) by the timing control, as shown in FIG. 4. When a pneumatic suction device 11, as shown in FIG. 6*a*, is used for the panty 35 instead of the resilient pincers 10—10, then the tube 11 is brought close to the support 40 and, after the panty 35 has been drawn into tube 40, the legs 36 after release by rods 60 are drawn into the same support 40. A timing control device connected to pincers 9, tubes 20, tube 11, permits the garment to be drawn into support 40.

Figure 5:
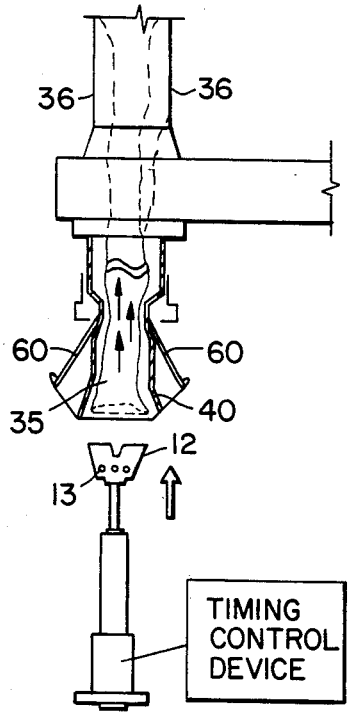
FIG. 5 shows, inactive, the further devices for stretching the edge of fabric in contact with the support after the garment has been completely drawn inside said support.

After the entire garment has been drawn inside the support (40), and only in the event there still are some wrinkles present on the edge of the fabric to be sewn to the gusset, the buffer (12) is actuated by its timing control is inserted with slight elastic pressure into the inlet (42) of the support (40). Buffer 12 performs a complete and final smoothing of the fabric located in the vicinity of the inlet (as shown in FIG. 5), and places its edge in the proper position for sewing the gusset.

Those skilled in this art will appreciate that the drawing shows herein all the necessary parts of the machine, and that various controls and other mechanisms employed to couple the present system with the automated feed machine, these are not part of the invention and would be conventional. A conventional computer can be added to the system, if necessary, to control the sequentially operating parts thereof.

Similarly, it would be obvious to one skilled in the art that the apparatus of the present invention would be used to deliver the pantyhose eventually to a sewing machine (not shown).

Similarly, U.S. Pat. No. 4,485,753 provides a basis for a definition. The gusset sewing machine to which the present invention is applied is generally composed of six operating stations. The present description here, in effect, relates to the first two stations of the machine.

As is well known, at the first station, automatic loading of the pantyhose takes place because of suction inside the hollow support 40 in order to stretch the garment. The suction operation inside the support and the suction itself are previously described, for example, in U.S. Pat. No. 4,485,753, issued Dec. 4, 1984, and French Pat. No. 2,443,523 published July 1, 1980.

The second station is the one which generally includes the device shown in FIG. 5, and when the machine operates during its normal work cycle, a carrousel which holds six hollow supports turns with a 60° rotation, bringing an automatically loaded pantyhose on the support in the first station by means of the pincers 9 on the second station. In the second station, the hollow support with the pantyhose on it is juxtaposed to the rubber buffer 12 of the device shown in FIG. 5. Once the machine stops after having operated during its rotation, the rubber buffer then moves up to compensate for the inside of the conical part of support 10 once or twice and it is pneumatically operated as required by the program operating the machine. For this purpose, the computer controller timing device labelled "timing control device" is shown connected to FIG. 5. The vertical up and down movement of the buffer inside the support 40 is automatically operated as the machine stops after every 60° rotation and performs a complete and final smoothing of the fabric laying in the vicinity of the edge of the support 10 which causes the wrinkles to disappear.

The timing control of the cylinder 80 can also be carried out by the control device, and it should be noted that the movement of the cylinder 80 is automatically obtained at every machine cycle and can be operated by an electronic program controller which controls the cycle of the machine, as described in U.S. Pat. No. 4,485,753. Furthermore, the rods 60 could, when in the open position, damage some other parts of the machine so that the form 90 operates the rods 60 through the pneumatic cylinder 80.

I claim:

1. In a machine for preparing a pantyhose having a panty portion formed of a fabric onto which a gusset is to be sewn for preventing formation of wrinkles on the edge of the fabric to which the gusset is to be sewn comprising:

a tubular support having an inlet for receiving therein the body of the pantyhose;

means coupled to said tubular support to hold thereto and circularly to stretch the edge of body of the pantyhose to be sewn to the gusset;

means for stretching the legs of the pantyhose and the body of the pantyhose in a lengthwise condition;

means to bring the pantyhose while maintaining it in its stretched condition close to said inlet;

means for drawing said pantyhose inside said support; and exterior means movable to the inside of said support for effecting further stretching of the edge in contact with said support.

2. The machine of claim 1, wherein said stretching means includes:

padded pincer means transversely movable relative the axis of said tubular support for gripping and releasing the legs of the pantyhose; and suction devices axially aligned with said tubular support and having openings for drawing lengthwise thereinto the legs of the pantyhose for stretching of the legs.

3. The machine of claim 1, wherein said stretching means includes:

a pneumatic suction device having an opening axially aligned with said tubular support for drawing the body of the pantyhose into said opening; and suction devices cooperating with said pneumatic suction device axially aligned with said tubular support and having openings for drawing thereinto the legs of the pantyhose for stretching thereof.

4. The machine of claim 1, wherein said means coupled to said tubular support includes:

a collar slidable axially along said tubular support and including housed therein a plurality circumferentially arranged rods each hingedly connected to said tubular support for oscillation relative thereto and having a hook at one free end thereof;

a pneumatic cylinder fixedly supported relative to said tubular support and including means engaging said collar for moving thereof axially relative to said tubular support for raising and lowering said collar;

grooves in said tubular support for receiving the other free ends of said rods such that said rods pivot about the hinged connection to said tubular support as said pneumatic cylinder causes said collar to slide axially along said tubular support to move said rods with the hook ends from a position adjacent to said tubular support in a lowermost position of said collar and to move said hook ends outwardly away from said tubular support in an uppermost position of said collar.

5. The machine of claim 1, wherein said stretching means includes:

a vertical pneumatic suction device movable horizontally to position itself axially underneath said support and vertically to approach said inlet of said support.

6. In a machine for feeding knitted garments formed into a pantyhose onto which a gusset is to be sewn, comprising:

a head including a tubular support symmetrical about a vertical axis and having a horizontal inlet;

a collar vertically slidable on said support and housing several straight rods circumferentially arranged and spaced angularly equidistantly, said rods having a lower hooked end and being hinged onto said support for vertical oscillation with a radial opening out of their said lower hooked end;

an elastic ring closed around the upper ends of said rods for causing said rods to open outwardly;

a pneumatic cylinder including a fork coupled to said collar for controlling the vertical travel thereof on said support;

pincers positioned underneath said support and consisting of two buffers movable horizontally towards and away from each other and movable together vertically in the same direction;

two vertical pneumatic suction devices positioned underneath said head; and an additional buffer positioned below said horizontal inlet for movement thereinto.

7. A machine according to claim 6, including a first horizontal circumferential groove on the outer surface of said tubular support, said first groove being semicircular in section; and a second groove on said tubular support above said first groove and with a triangular profile in section.

8. A machine according to claim 7, wherein said collar includes several longitudinal slots housing said rods, a pin fitted to each said rod projecting transversally outward, a horizontal flange intercepting said pins when said collar is lowered, and a horizontal groove housing the free end of said fork.

9. The machine according to claim 8, wherein the pads of said pincers are made of rubber to provide a good hold on the fabric of the garment.

10. The machine according to claim 9, including two pneumatic suction devices operable to release the legs of the garment, one at a time.

11. The machine according to claim 10, wherein said additional buffer is cup-shaped and provided with several lateral holes, said additional buffer having a diameter at the top so that it can be inserted into said inlet of said support with slight elastic pressure.

12. The machine according to claim 6, wherein said rods include a semicircular projection, a hinge coupling said projection to said support, a groove in said support for housing said projection, a hinged pin projecting radially outward from said rods and of such length that it can be intercepted by a flange in said collar, and a projection in front of said hooked end of said rods.

13. In an apparatus for use with a machine for sewing gussets onto knitted garments of the "pantyhose" type with automated feed, comprising:

a head including:

a tubular support (40) with a vertical axis and a horizontal inlet (42), a collar (50) sliding vertically on said support (40) and housing several circularly arranged straight rods (60), said rods each having a lower hooked end and being angularly equidistant and hinged onto said support (40) for vertical oscillation and for a radial opening out of their said lower hooked end (63);

an elastic ring (70) closed around upper ends (62) of said rods (60) for producing the opening out of said rods (60), a pneumatic cylinder (80) and a fork (90) controlling the vertical travel of said collar (50) on said support (40) through the interposition of said fork (90);

means underneath said support (40) movable together horizontally in opposite directions and vertically in the same direction;

two vertical pneumatic suction devices (20) located in an area underneath said head; and an additional buffer (12) coaxially positioned underneath said support coaxially vertically introducible selectively into an inlet (42) of said support (40).

14. In an apparatus according to claim 13, wherein said support (40) has on its outer surface a first horizontal circumferential groove (43), semi-circular in section, and a second groove (44) having a triangular profile section above said first horizontal circumferential groove.

15. In an apparatus according to claim 13, wherein said collar (50) includes several longitudinal slots (51) housing said rods (60), a horizontal flange (52) intercepting transversely outwardly projecting pins (64) provided on said rods (60) and a horizontal groove (53) housing a free end of said fork (90).

16. In an apparatus according to claim 21, wherein each of said rods (60) includes:

a semicircular projection (61) housed in a groove (43) of said support (40);

a hinged pin (64) projecting radially outwardly and of such a length that it is interceptable by a flange (52) in said collar (50); and a projection (65) in front of said lower hooked end (63).

17. In an apparatus according to claim 13, wherein said means underneath said support comprises pincers (10—10) including buffers made of rubber or similar material to provide a good hold on the fabric of the knitted garment.

18. In an apparatus according to claim 13, wherein said means underneath said support comprises a vertical penumatic suction device (11) movable horizontally to position itself axially underneath said support (40) and vertically to approach the inlet of said support (40).

19. In an apparatus according to claim 13, including means associated with said two pneumatic suction devices (20) for operating thereof to release the legs (36) of the garment, one at a time.

20. In an apparatus according to claim 13, wherein said additional buffer (12) is shaped as a cup and has several lateral holes (13) and a diameter at the top such that it is introducible with slight elastic pressure into the inlet of said support (40).

* * * * *